US010571094B2

(12) United States Patent
Germain

(10) Patent No.: US 10,571,094 B2
(45) Date of Patent: Feb. 25, 2020

(54) MOVABLE TRAY FOR A SUSPENDED LIGHT FIXTURE

(71) Applicant: Current Lighting Solutions, LLC, East Cleveland, OH (US)

(72) Inventor: Steve Germain, L'lle-Perrot (CA)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 712 days.

(21) Appl. No.: 14/138,235

(22) Filed: Dec. 23, 2013

(65) Prior Publication Data

US 2015/0176803 A1 Jun. 25, 2015

(51) Int. Cl.

| | |
|---|---|
| ***F21V 1/00*** | (2006.01) |
| ***F21V 7/10*** | (2006.01) |
| ***F21V 21/02*** | (2006.01) |
| ***F21S 8/06*** | (2006.01) |
| ***F21V 7/00*** | (2006.01) |
| ***F21V 23/02*** | (2006.01) |
| *F21V 21/005* | (2006.01) |
| *F21Y 103/00* | (2016.01) |

(52) U.S. Cl.

CPC ..... *F21V 7/10* (2013.01); *F21S 8/06* (2013.01); *F21V 7/005* (2013.01); *F21V 21/025* (2013.01); *F21V 23/02* (2013.01); *F21V 23/026* (2013.01); *F21V 21/005* (2013.01); *F21Y 2103/00* (2013.01)

(58) Field of Classification Search

CPC ..... F21V 7/10; F21V 21/025; F21V 23/026; F21V 21/005; F21V 7/005; F21V 23/02; F21V 23/023; F21Y 2103/00; F21S 8/06

USPC ..... 362/217.05, 296.01, 341, 609

See application file for complete search history.

(56) References Cited

U.S. PATENT DOCUMENTS

| | | | | |
|---|---|---|---|---|
| 6,585,396 | B1 | 7/2003 | Verfuerth | |
| 2002/0136001 | A1* | 9/2002 | Lefkovitz | E04B 9/006 362/147 |
| 2008/0259599 | A1 | 10/2008 | Fowler et al. | |
| 2010/0172129 | A1 | 7/2010 | Hsieh | |
| 2012/0069557 | A1* | 3/2012 | Bolscher | 362/217.16 |

FOREIGN PATENT DOCUMENTS

| | | | |
|---|---|---|---|
| DE | 4300415 | A1 | 7/1994 |
| GB | 615712 | A | 1/1949 |

OTHER PUBLICATIONS

International Search Report and Written Opinion issued in connection with corresponding PCT Application No. PCT/US2014/068118 dated Feb. 18, 2015.

Office Action issued in connection with corresponding EP Application No. 14821929.8 dated Mar. 22, 2018.

* cited by examiner

*Primary Examiner* — Anh T Mai
*Assistant Examiner* — Nathaniel J Lee
(74) *Attorney, Agent, or Firm* — Buckley, Maschoff & Talwalkar LLC

(57) ABSTRACT

In some embodiments, aspects of this disclosure provide a system including a reflector of a suspension lighting fixture, the reflector having a reflective underside and a top side; at least two ribs affixed to the top side of the reflector; and a tray base is attached between two adjacent ribs of the at least two ribs. A benefit is that a tray base (and other components attached thereto) may be efficiently positioned at various positions along the length of the reflector.

21 Claims, 14 Drawing Sheets

MOVABLE TRAY FOR A SUSPENDED LIGHT FIXTURE

BACKGROUND

Suspended light fixtures may be used in a variety of commercial, industrial, and residential applications. Such light fixtures may be suspended from a ceiling or other overhead support structure. Accordingly, the suspended light fixture needs to be mounted or attached to the ceiling or other support structure. Typically, a light fixture includes a mounting component that is located at a fixed location on the lighting fixture and great care is needed in the mounting of the light fixture to ensure that the mounting component aligns with a corresponding attachment point on the ceiling or other support structure. This problem is further highlighted when multiple light fixtures are arranged in a continuous run that may include up to forty or more light fixtures.

One potential solution to the above-mentioned problem is to provide a light fixture with a continuous mounting system that runs the entire length of the light fixture. However, such a system adds more material, costs, weight, and complexity to the light fixture. Also, such systems may be inefficient since the light fixture does not typically need to be attached to the ceiling or other support structure along its entire length.

Typical light fixtures may include one or more junction boxes or enclosures for holding a power supply or transformer. However, the one or more junction boxes or enclosures are set at a fixed location on the light fixture.

Therefore, it would be desirable to provide improved light fixture apparatuses.

BRIEF DESCRIPTION OF THE DRAWINGS

Features and advantages of some embodiments of the present invention, and the manner in which the same are accomplished, will become more readily apparent upon consideration of the following detailed description of the invention taken in conjunction with the accompanying drawings, wherein.

DETAILED DESCRIPTION

Figure 1:
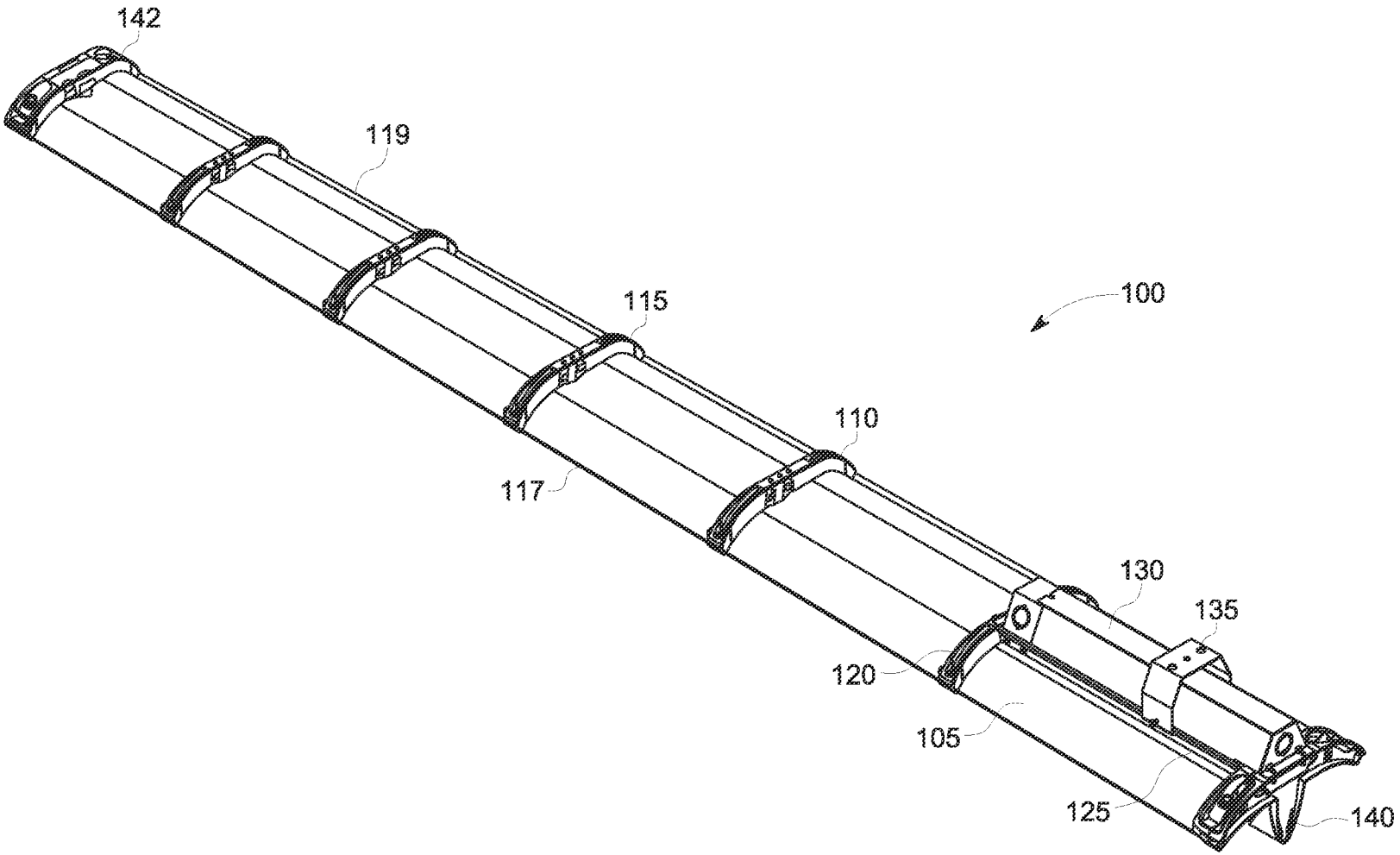
FIG. 1 is a perspective view of a light fixture showing a top side of a reflector of the light fixture, according to some embodiments herein.

FIG. 1 is a perspective view of a light fixture 100 showing a top side of a reflector 105 of the light fixture, according to some embodiments herein. In some embodiments, light fixture 100 may comprise a suspended light fixture meant to be suspended from a ceiling or other support structure. In some embodiments, reflector 105 may be constructed of, at least in part, a sheet of metal. For example, reflector 105 may be formed by bending and shaping a length of sheet metal. Light fixture 100 further includes a number of ribs attached to a top side of reflector 105, including ribs 110, 115, and 120. The ribs may connect to reflector 105 at a flange 117 and a flange 119. When attached to reflector 105, the ribs operate to maintain a particular shape of the reflector.

In some aspects, the number of ribs 110, 115, and 120 used in a particular configuration of light fixture 100 may depend, at least in part, on a desired measure of rigidity or support to be provided to the reflector by the ribs. In some aspects, the inclusion of more ribs may result in providing more rigidity and support to maintain the shape of reflector 105.

Light fixture 100 further includes a tray base 125. Tray base 125 is selectively positioned between any two of the ribs mounted to a top side of reflector 105. That is, the ribs are spaced apart to support a tray base positioned between two adjacent ribs. The tray base may be attached to the ribs by any number and type of connections, including but not limited to those explicitly disclosed herein. A tray cover 130 is attached to tray base 125. Tray base 125 and tray cover 130 cooperate to form an enclosure. In some contexts, one or more light fixture components may be housed within the enclosure formed by tray base 125 and tray cover 130. Further shown in FIG. 1 is a mounting bracket 135 that may also attach to tray base 125. Mounting bracket 135 may be used to attach light fixture 100 to a support structure such as, for example, a ceiling.

Light fixture 100 fixture includes an end cap rib at the terminal ends of reflector 105. As shown, a first end cap rib 140 is located at one end of light fixture 105 and a second end cap rib 142 is located at the other opposing end of light fixture 105. An end cap rib may operate to maintain a shape of reflector 105 and provide an attachment point for a tray base and a mounting bracket like other ribs 110, 115, and 120. However, an end cap rib may further provide a structure for connecting two light fixtures together in a continuous "run" configuration that includes multiple light fixtures arranged in an end-to-end configuration (not shown).

In some embodiments, the ribs attached to the top side of reflector 105 are evenly spaced apart along the length of light fixture 100, wherein the space between two adjoining ribs is set to accommodate a tray base therebetween. In this manner, a tray base 125 may selectively be positioned between any two adjacent ribs (e.g., ribs 110 and 120; ribs 120 and 140; etc.). More particularly, the tray base may be movably (e.g., removably) attached to the reflector so as to be repositionable between any two adjacent ribs of the at least two ribs. A benefit of such spacing of the ribs is that a tray base (and other components attached thereto) may be efficiently positioned at various positions along the length of the reflector. Furthermore, such flexibility in the positioning of a tray base is achieved with minimal structures as illustrated by the light fixture of FIG. 1.

Figure 2:
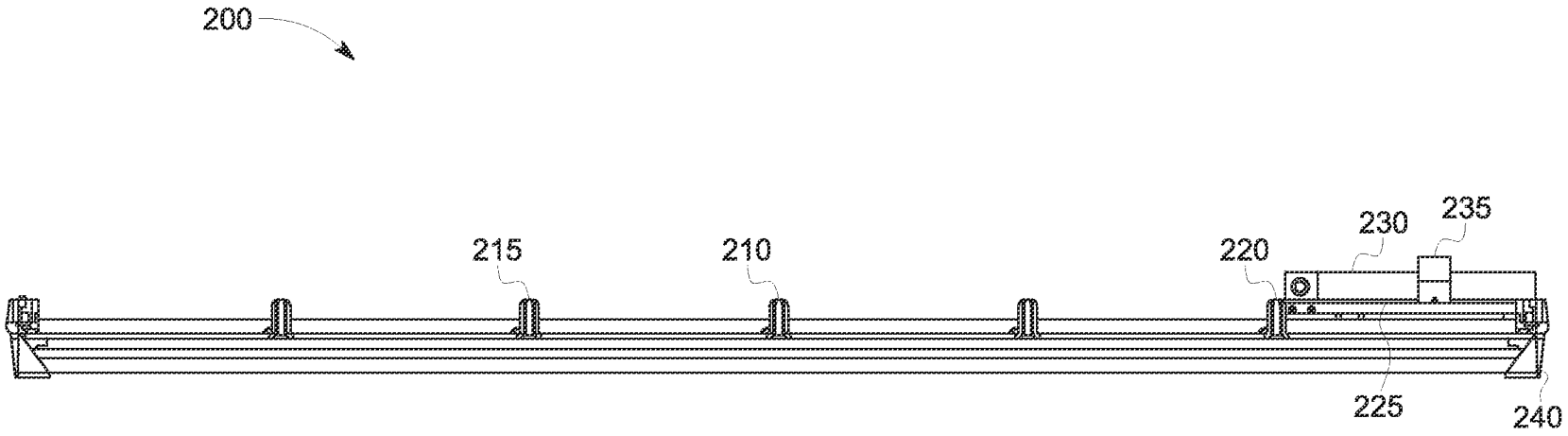
FIG. 2 is a side profile view of a light fixture, according to some embodiments herein.

FIG. 2 is a side elevation view of a light fixture 200, in accordance with some embodiments herein. Light fixture 200 includes a reflector that has a multiple number of ribs (e.g., 210, 215, 220, and end cap rib 240) attached to a top side thereof. A tray base 225 is attached between ribs 220 and 240. A tray cover 230 and a mounting bracket 235 are shown attached to tray base 225.

Figure 3:
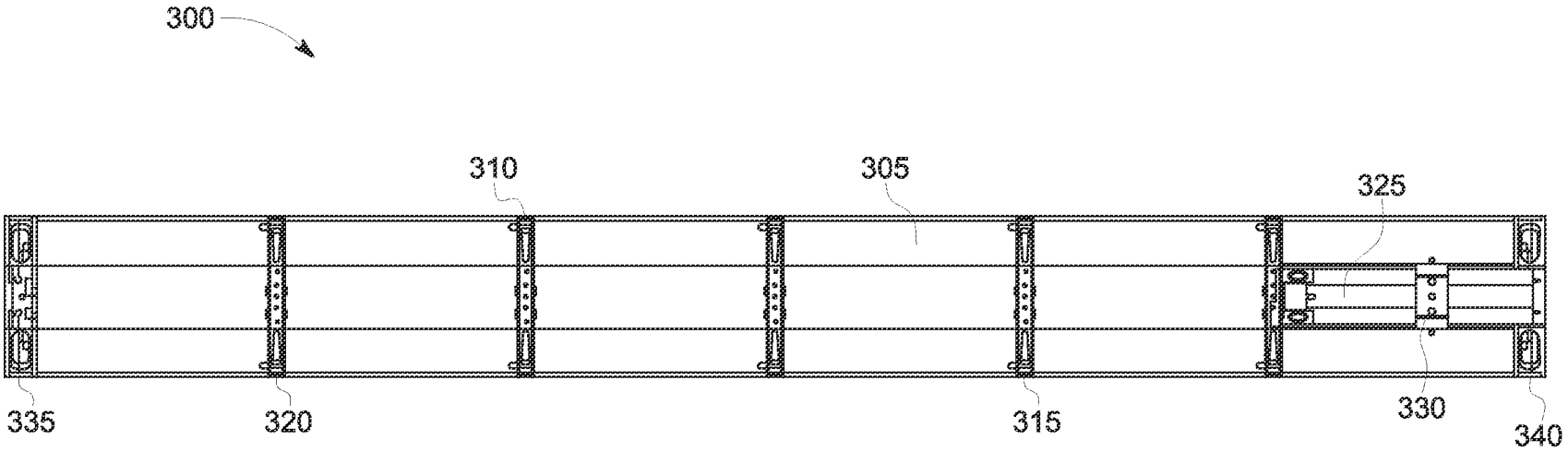
FIG. 3 is top-down view of a light fixture, in accordance with some embodiments herein.

FIG. 3 is a top-down view of a light fixture 300, in accordance with some embodiments herein. Light fixture 300 includes a reflector 305 having multiple ribs (e.g., 310, 315, 320, and end cap ribs 335 and 340) attached to a top side of reflector 305. A tray base (not visible) is attached between two ribs and includes a tray cover 325 and a mounting bracket 330.

Figure 4:
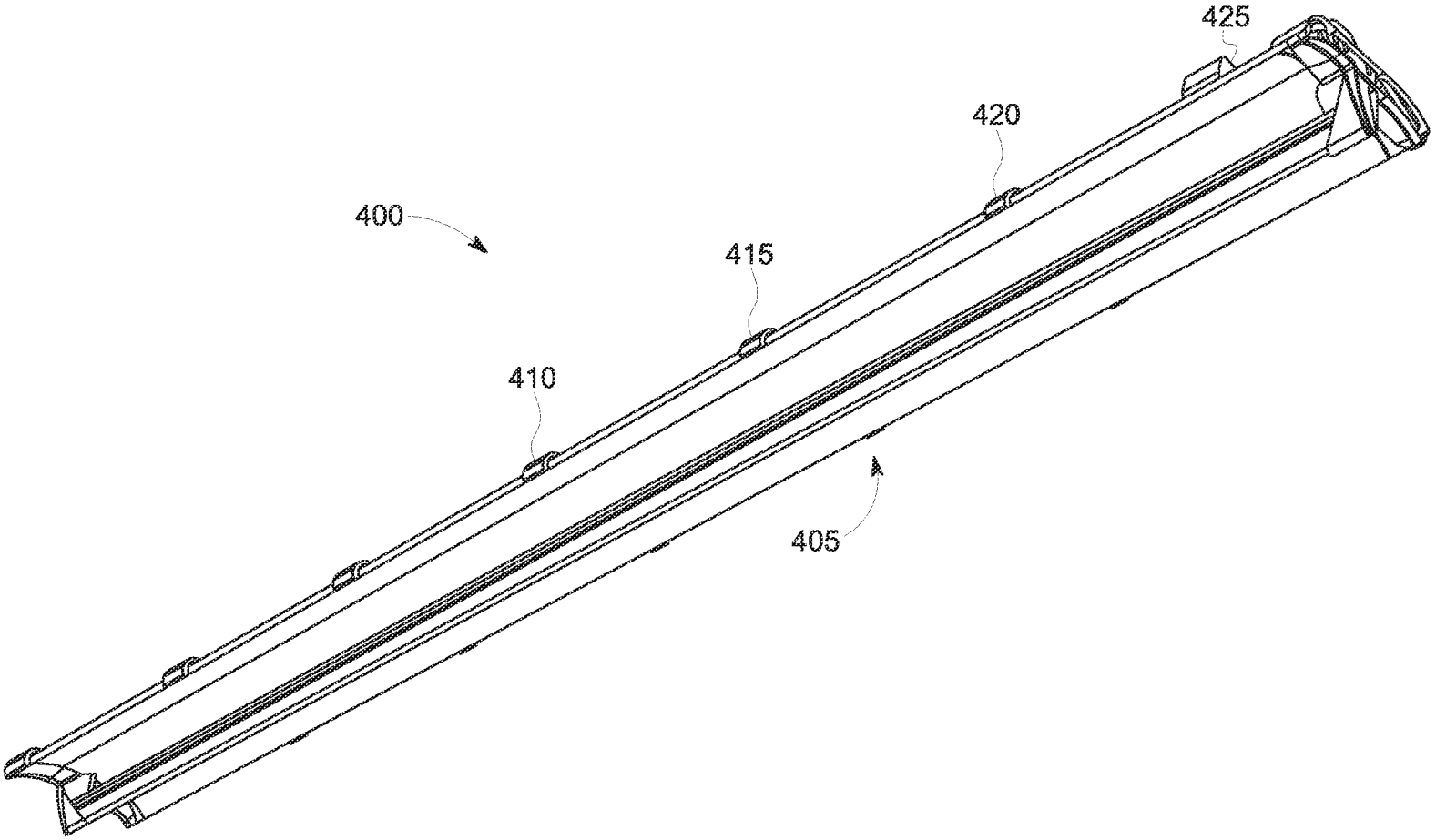
FIG. 4 is a perspective view of a light fixture showing a bottom side of a reflector of the light fixture, in accordance with some embodiments herein.

FIG. 4 is a perspective view of a light fixture 400 showing an underside of a reflector 405 of the light fixture, according to some embodiments herein. In some embodiments, light fixture 400 may comprise a suspended light fixture meant to be suspended from a ceiling or other support structure. As such, the underside of reflector 405 may normally be visible to a person looking up at the light fixture suspended from a ceiling or other overhead structure. In some embodiments, reflector 405 may be constructed of, at least in part, a sheet of metal. The underside of reflector 405 may additionally be coated with a (highly) reflective coating that is deposited on the reflector to reflect light from a light source or light engine (not shown) placed in the light fixture towards the direction below the light fixture. Light fixture 400 further includes a number of ribs attached to a top side of reflector 405, including ribs 410, 415, and 420. Further shown is a tray cover 425 that is attached to a tray base (not shown) that is attached to a top side of reflector 405. In some aspects, tray cover 425 may not be visible when light fixture is mounted to a ceiling or other overhead support structure.

Figure 5:
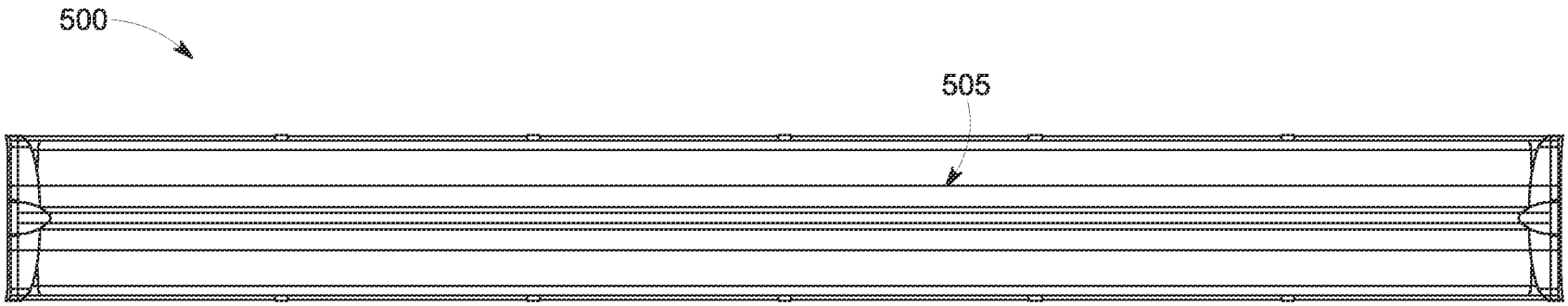
FIG. 5 is a view of a light fixture showing a bottom side of a reflector of the light fixture, in accordance with some embodiments herein.

FIG. 5 is an illustrative plan view looking up at an underside of a light fixture 500 that includes a reflector 505. As shown in FIG. 5, ribs and other features of the light fixtures disclosed herein, such as a tray base, a tray cover, and a mounting bracket are not visible in the view of FIG. 5.

Figure 6:
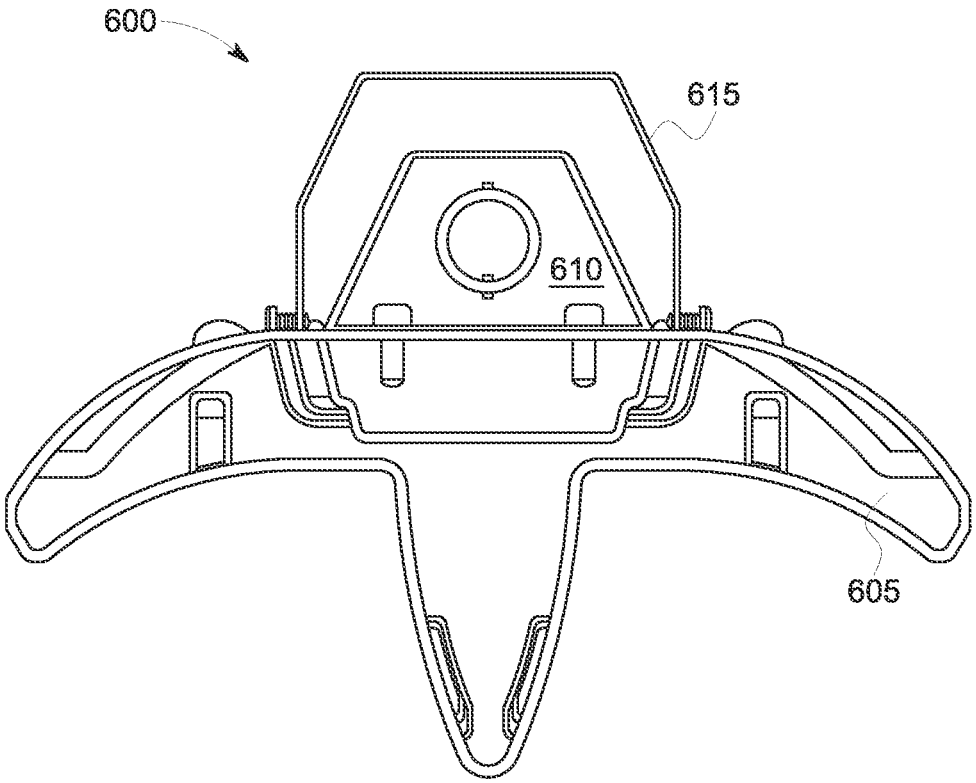
FIG. 6 is a end view of a light fixture, in accordance with some embodiments herein.

FIG. 6 is an illustrative end view of a light fixture 600, including an end cap rib 605. End cap rib 605 may be constructed of a plastic material, a metal material, combinations thereof, and other materials. Visible in FIG. 6 is a tray cover 610 and a mounting bracket 615 attached to end cap rib 605.

Figure 7:
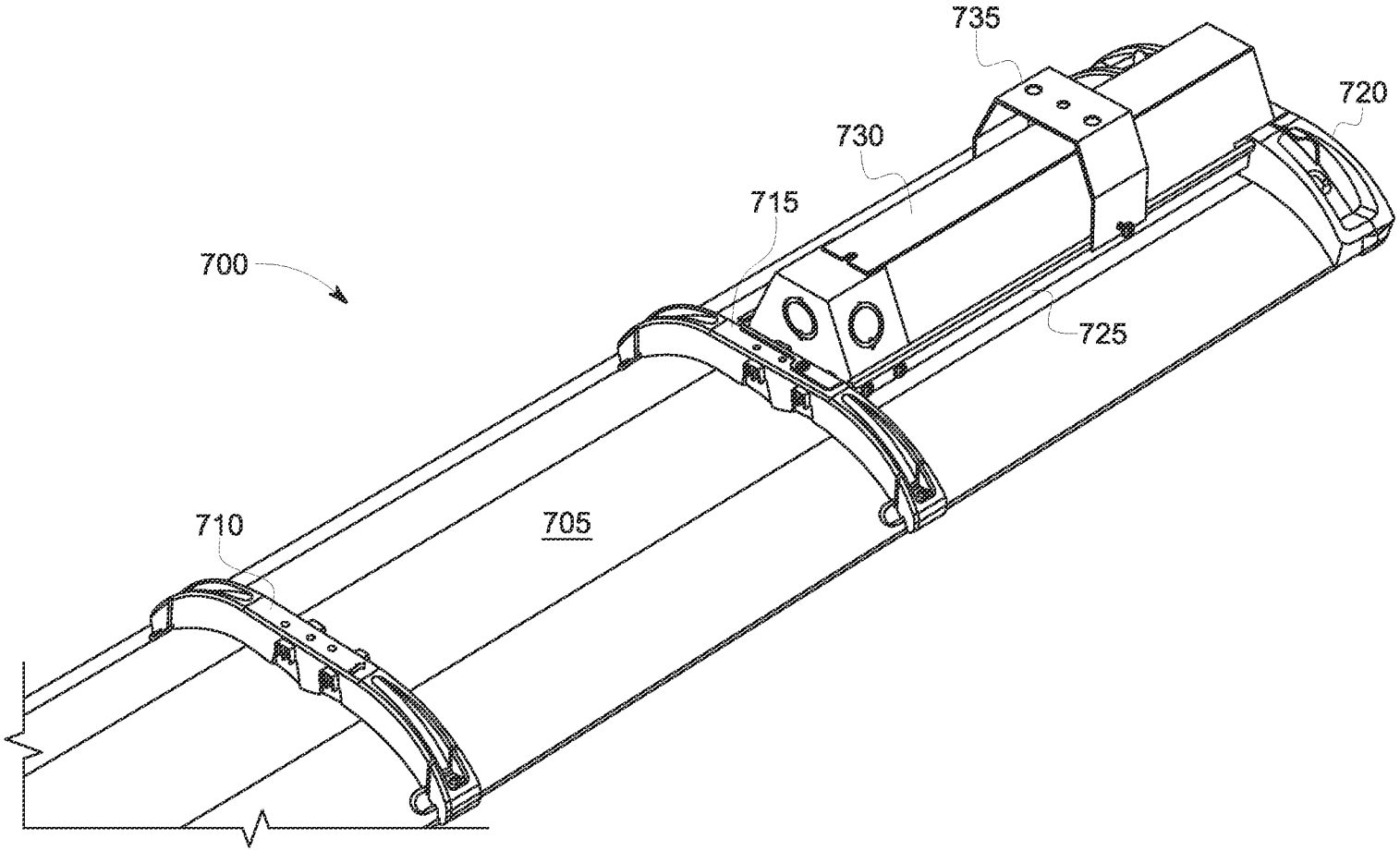
FIG. 7 is a perspective view of a light fixture, in accordance with some embodiments herein.

FIG. 7 is a perspective view of a light fixture 700. FIG. 7 reveals a close-up view of certain aspects of light fixture 700. In particular, FIG. 7 shows a top side of a reflector 705 that has ribs 710 and 715 attached thereto. Also attached to the top of reflector 705 is an end cap rib 720. A tray base 725 is mounted between end cap rib 720 and rib 715, wherein these ribs are spaced to allow tray base 725 to fit therebetween. In some embodiments, the spacing between ribs 710 and 715 is equal to the spacing between rib 715 and end cap rib 720. End cap rib 720 and rib 715 also provide an attachment point for attaching tray base 725 to light fixture 700. A tray cover 730 and mounting bracket 735 are attached to tray base 725.

Figure 8:
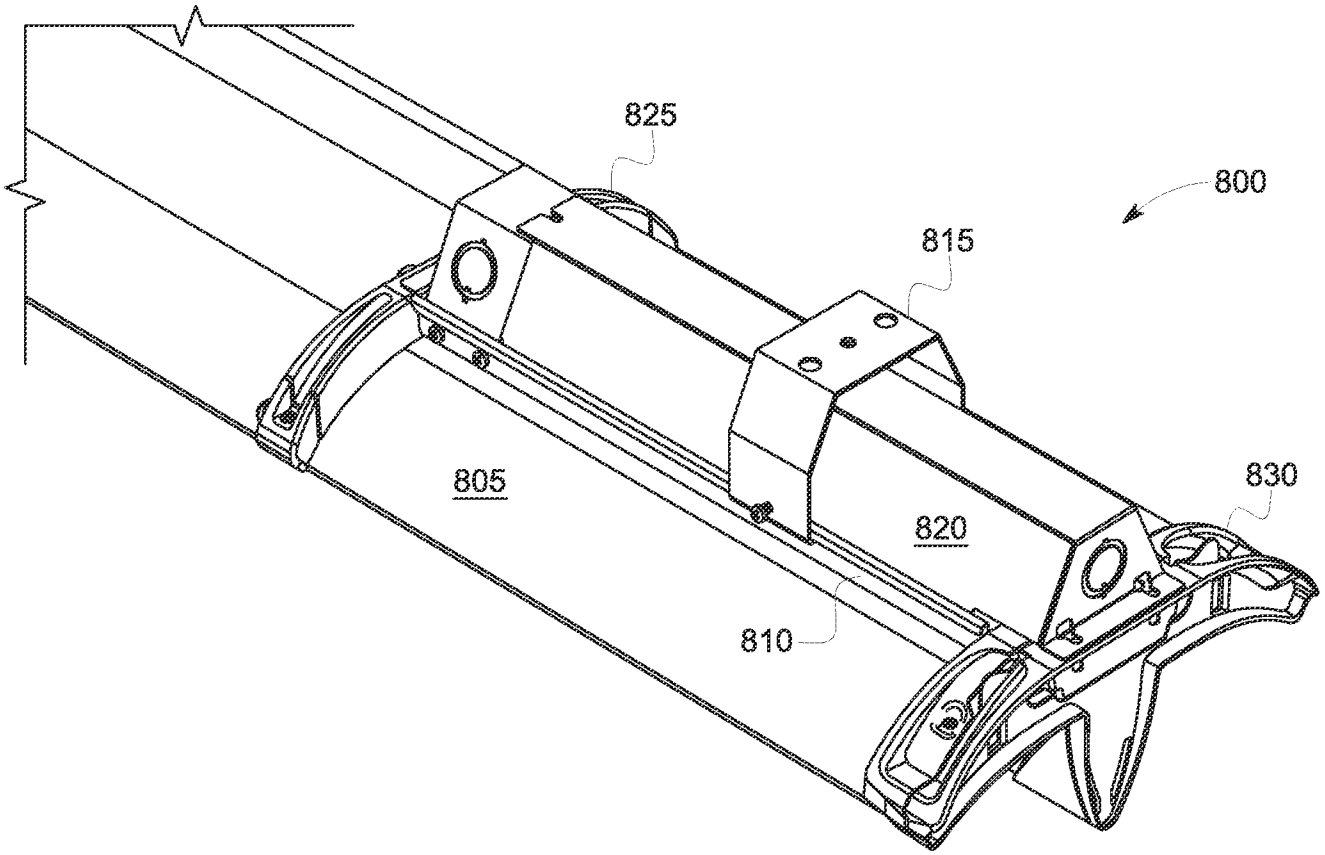
FIG. 8 is a perspective view of a light fixture showing a number of features thereof, according to some embodiments herein.

FIG. 8 is a perspective view of a light fixture 800, showing in detail, certain aspects of light fixture 800. In particular, FIG. 8 shows a top side of a reflector 805 that has ribs 825 and 830 (end cap rib) attached thereto. A tray base 810 is mounted between end cap rib 830 and rib 825, wherein these adjacent ribs are spaced apart to allow tray base 810 to fit between them. End cap rib 830 and rib 825 also provide an attachment point for attaching tray base 810 to light fixture 800. A tray cover 820 and mounting bracket 815 are attached to tray base 810.

In some embodiments, the length of tray base 810 is about 8 inches to about 20 inches, with a length of about 12 inches to about 15 inches being preferable. In some embodiments, a tray base and a tray cover may cooperate to form an enclosure when both are attached to a tray base. In some aspects, the enclosure formed by a tray base and a tray cover may be used to house light fixture components such as, for example, a power source, a transformer, electrical wires and connectors, and other devices. In some regards, the enclosure formed by a tray base and a tray cover may be sized to comply with one or more regulatory codes, laws, industry standards, and design considerations. The size of the enclosure will have a corresponding size impact on the tray cover and tray base.

Figure 9:
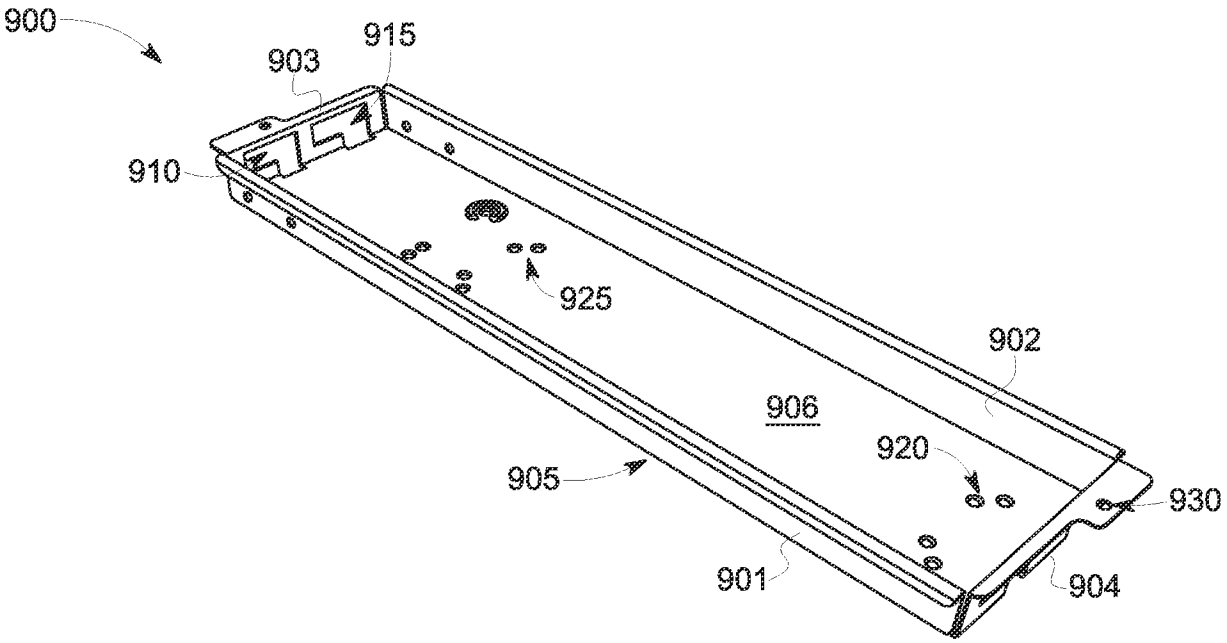
FIG. 9 is a perspective view of a tray base of a light fixture showing a number of features thereof, according to some embodiments herein.

FIG. 9 is an illustrative depiction of a device 900. Device 900 includes a tray base 905. Tray base 905 may comprise a bottom surface or bottom 906 and four upright side walls 901, 902, 903, and 904 attached to a periphery of the bottom. In some aspects, there may be a space between a bottom surface of the tray base attached between two of the at least two ribs and a top surface of the reflector. In some aspects, tray base 905 includes one or more accessory or component attachment features 920 and 925 that may be used to attach a power supply or other device to the tray base. In some embodiments, the attachment feature includes a threaded screw hole. Further shown in FIG. 9 are attachment features 910, 915, and 930. These attachment features may mate with corresponding attachment features on ribs affixed to a light fixture (not shown in FIG. 9).

Figure 10:
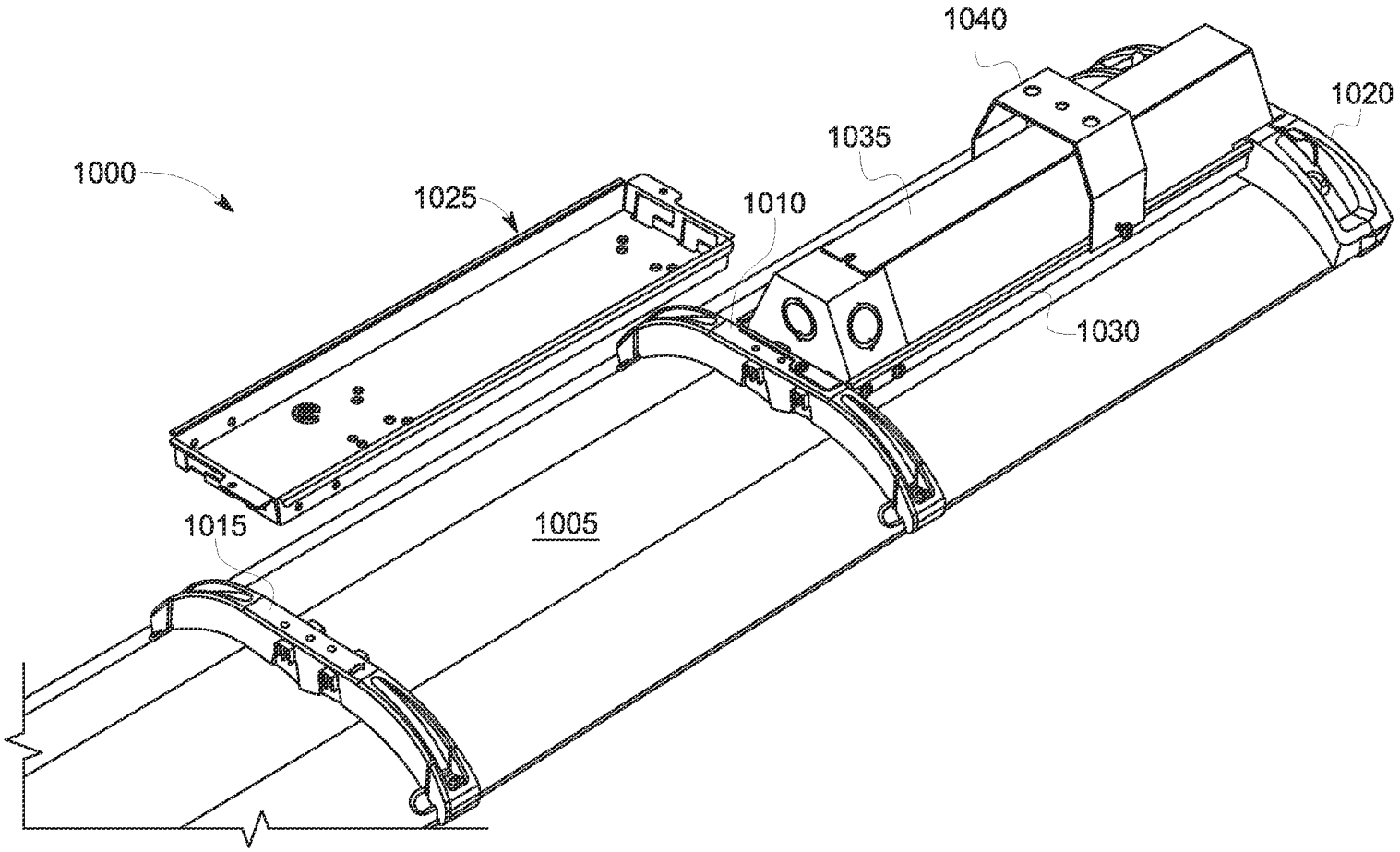
FIG. 10 is a perspective view of a tray base, tray cover, and mounting bracket of a light fixture, according to some embodiments herein.

FIG. 10 is an illustrative depiction of a light fixture 1000. Light fixture 1000 includes a reflector 1005 and ribs 1010, 1015, and 1020 (end cap rib). Also included are a tray base 1030, a tray cover 1035, and a mounting bracket 1040. While tray base 1030 is shown attached to the reflector at attachment points on ribs 1010 and 1020, tray base 1025 is yet to be positioned between two adjacent ribs (e.g., 1010 and 1015) for attachment to reflector 1005.

Figure 11:
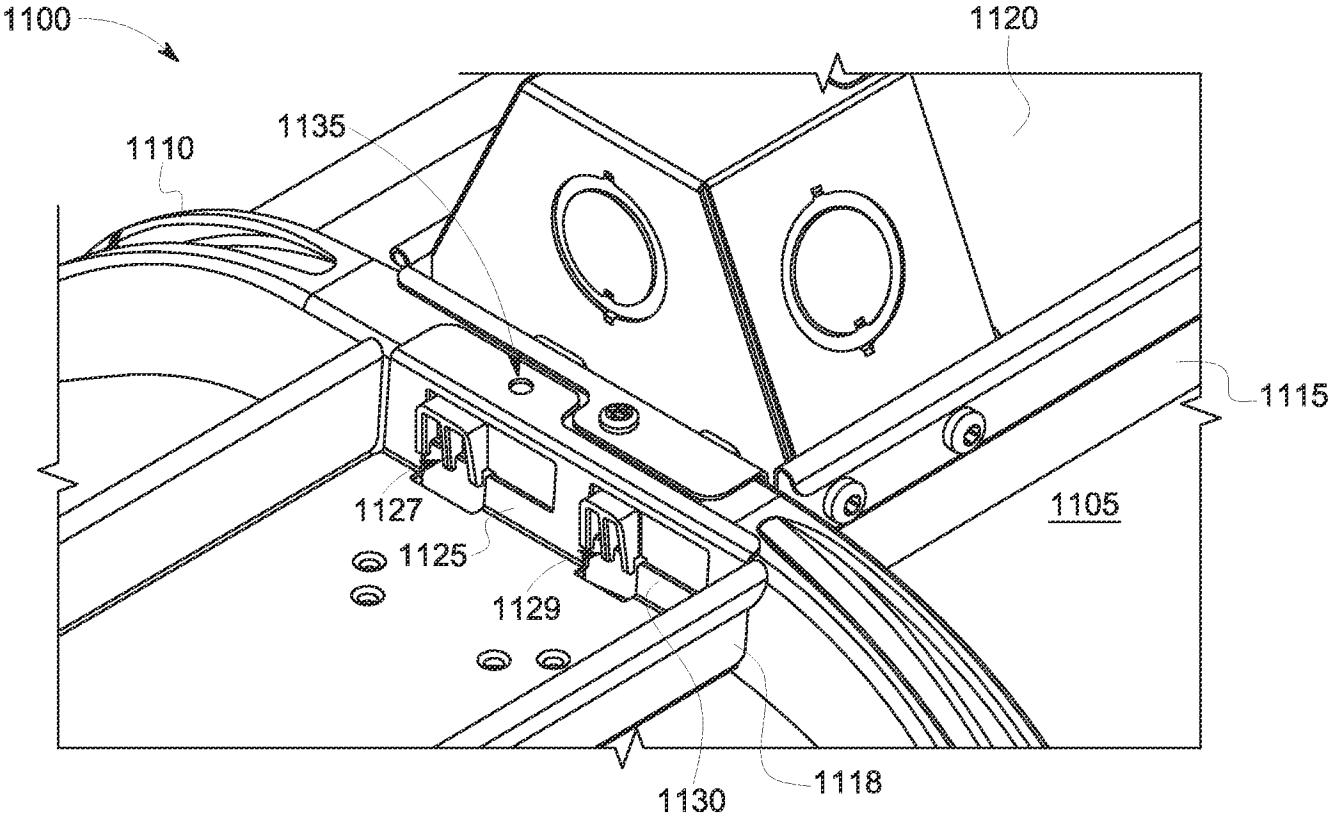
FIG. 11 is a perspective view of a tray base of a light fixture showing a number of features thereof, according to some embodiments herein.

FIG. 11 is an illustrative depiction of a light fixture 1100. Light fixture 1100 includes a reflector 1105 and a rib 1110. Also included are a tray base 1115 and a tray cover 1120. FIG. 11 illustrates in detail how the attachment features of the bracket openings 1125 and 1130 on tray base 1118 cooperate and correspond to the attachment features including brackets 1127 and 1129 on rib 1110 so that the tray base may be attached to the reflector via rib 1110. As shown in FIG. 11, tray base 1118 is positioned so that the brackets 1127 and 1129 are protruding through bracket openings 1125 and 1130.

Figure 12:
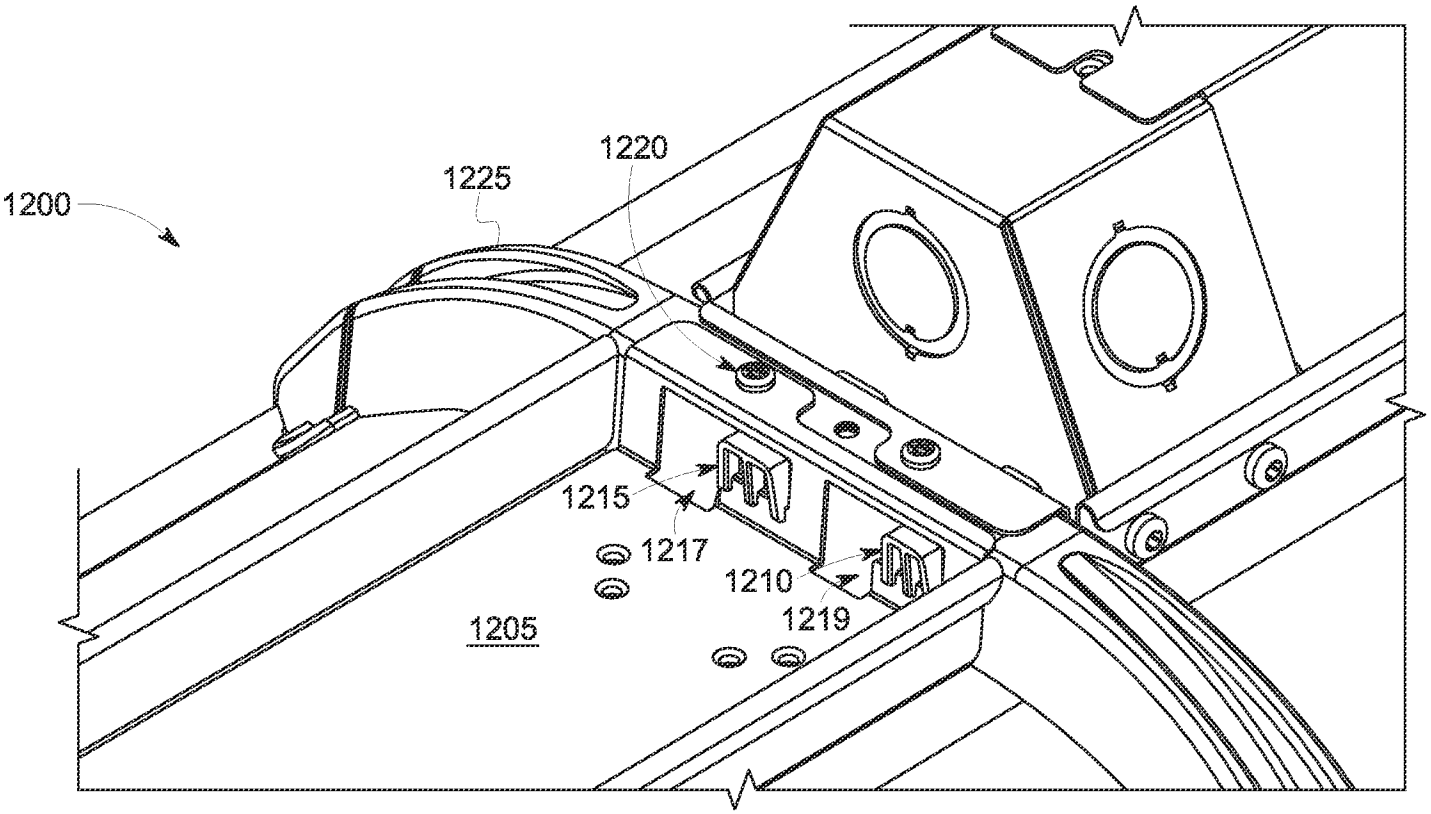
FIG. 12 is a perspective view of a tray base of a light fixture showing a number of mounting features thereof, according to some embodiments herein.

FIG. 12 is an illustrative depiction 1200 showing a tray base 1205 where the tray base has been moved into a "locked" positioned based on a configuration of brackets 1210 and 1215 relative to bracket openings 1217 and 1219. In some aspects, tray 1205 has been slid into the depicted position to engage the tray base with the rib 1225. In some embodiments, another attachment feature for attaching the tray base to the rib includes a screw hole in the tray base into which screw 1220 is shown located.

Figure 13:
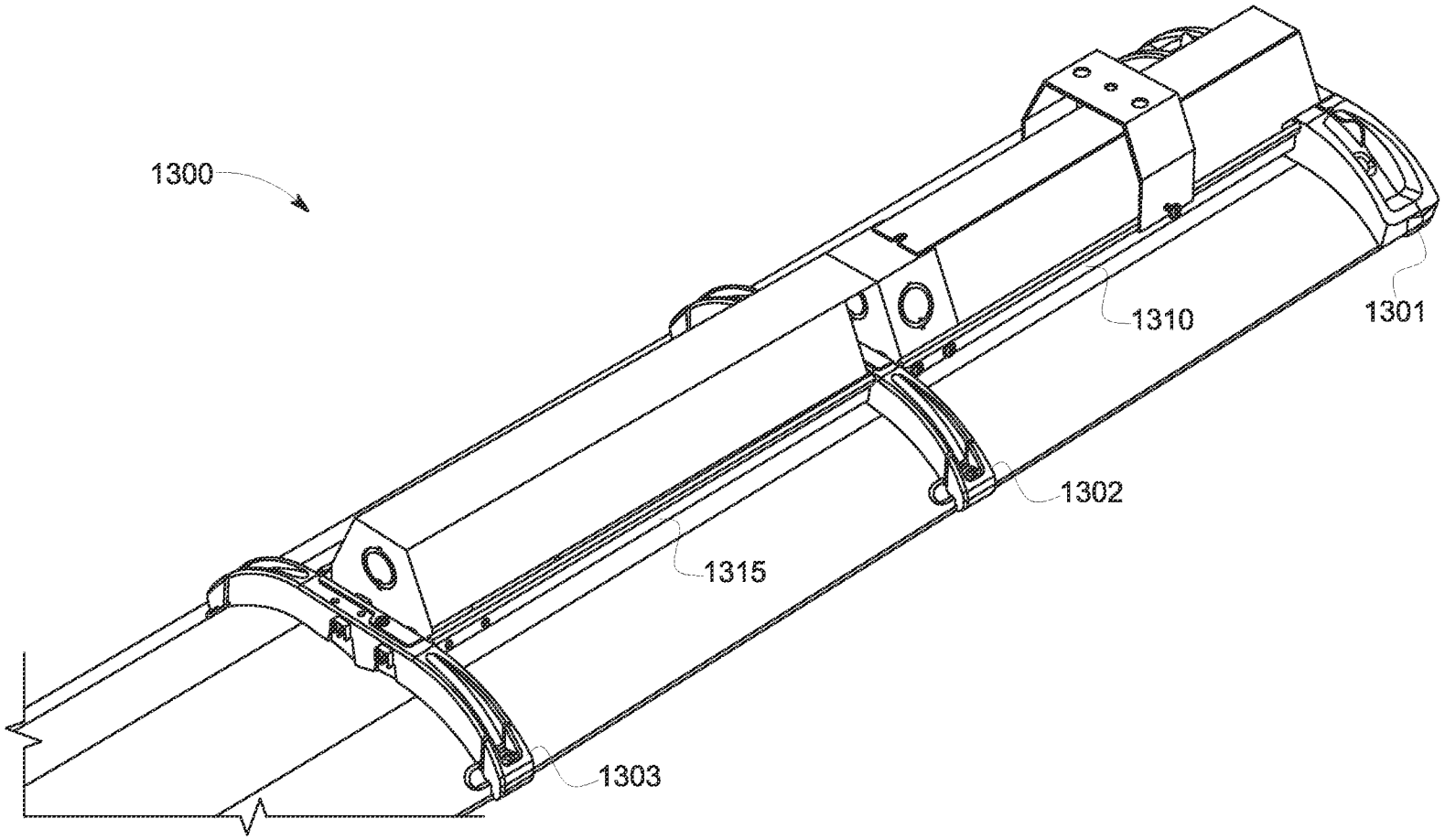
FIG. 13 is a perspective view of a light fixture including multiple trays, according to some embodiments herein.

In some aspects, more than one tray base may be located on any one light fixture. FIG. 13 illustrates this aspect of the present disclosure by showing a light fixture 1300 having ribs 1301, 1302, and 1303, where tray base 1310 is attached to the reflector via end cap rib 1301 and rib 1302 and tray base 1315 is attached to the reflector via rib 1302 and rib 1303.

Figure 14:
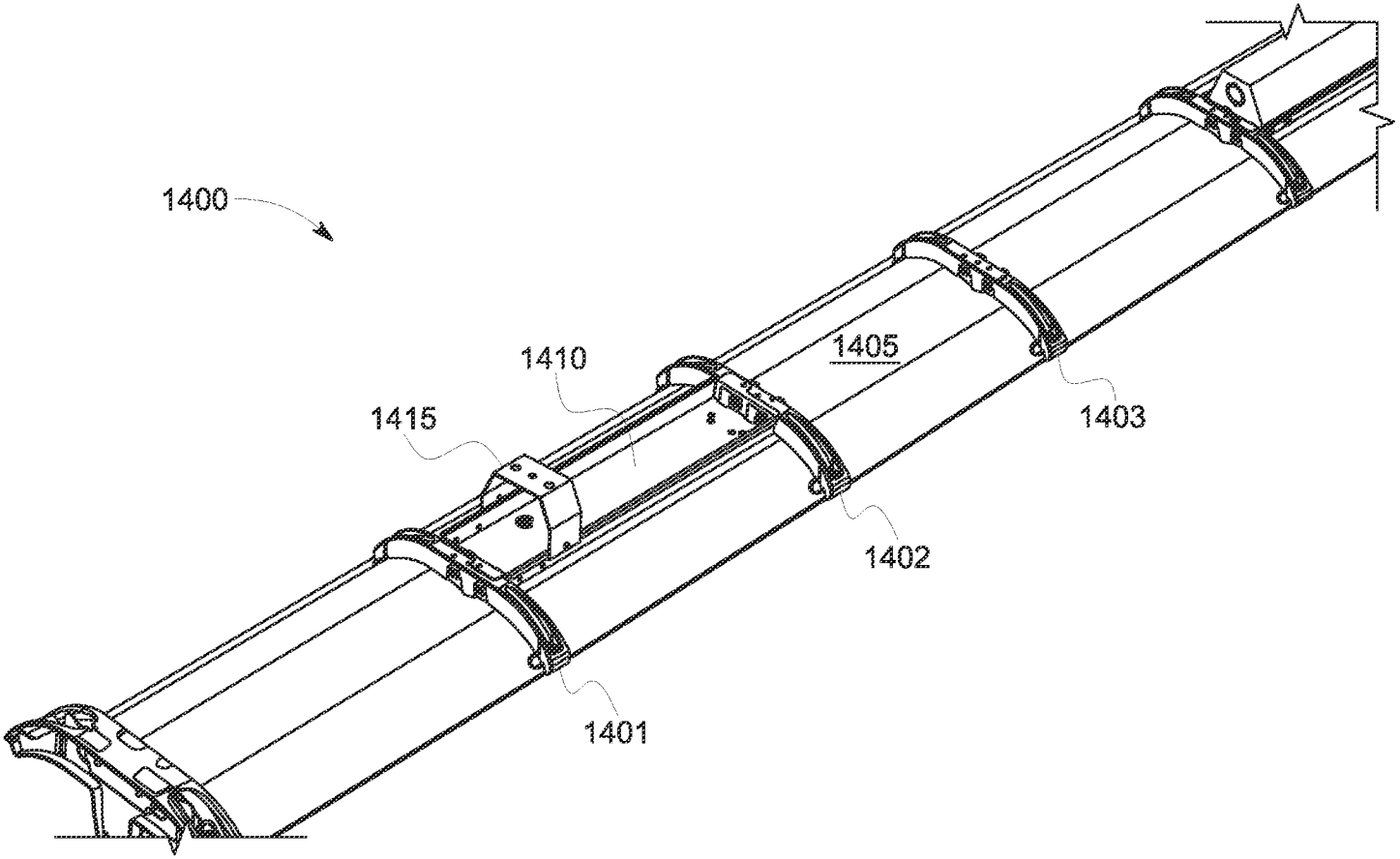
FIG. 14 is a perspective view of a light fixture including a tray base and a mounting bracket, according to some embodiments herein.

In some aspects, a tray base may be attached to a reflector of a light fixture with or without a tray cover. FIG. 14 illustrates this aspect of the present disclosure by showing a light fixture 1400 having ribs 1401, 1402, and 1403, where tray base 1410 is attached to the reflector 1405 via rib 1401 and rib 1402. However, while tray base 1410 has a mounting bracket 1415 attached thereto, no tray cover is attached to the tray base. This aspect of the present disclosure further demonstrates, in one aspect, the flexible configurable nature of the light fixture systems disclosed herein.

In some aspects, the light fixtures disclosed herein may be about two feet, about four feet, and about eight feet in length. However, other lengths are contemplated and within the scope of the present disclosure. Additionally, the construction materials for the various disclosed components and features herein may include metals, plastics, and other materials.

Embodiments have been described herein solely for the purpose of illustration. Persons skilled in the art will recognize from this description that embodiments are not limited to those described, but may be practiced with modifications and alterations limited only by the spirit and scope of the appended claims.

What is claimed is:

1. A system comprising:

a reflector of a suspension lighting fixture, the reflector having a reflective underside and a top side;

at least three ribs affixed to the top side of the reflector, the at least three ribs operate to maintain a shape of the reflector; and a tray base attached between two adjacent ribs of the at least three ribs;

wherein the tray base further comprises a first attachment feature and each of the at least three ribs further comprises a second attachment feature, wherein the first attachment feature and the second attachment feature operate to attach the tray base to the reflector between any two adjacent ribs of the at least three ribs;

and wherein the first attachment feature is at least one of a bracket opening and a fastener opening and the second attachment feature is at least one of a bracket and a fastener opening corresponding to the fastener opening of the first attachment feature.

2. The system of claim 1, wherein the first attachment feature and the second attachment feature matingly cooperate to attach the tray base to the reflector between any two adjacent ribs of the at least three ribs.

3. The system of claim 1, wherein at least one of the at least three ribs is not located at a terminal end of the reflector.

4. The system of claim 1, wherein each of the two adjacent ribs having the tray base attached therebetween is not located at a terminal end of the reflector.

5. The system of claim 1, further comprising a tray cover attached to the tray base and defining, in cooperation with the tray base, an enclosure.

6. The system of claim 5, wherein the enclosure defined by the tray cover attached to the tray base is to house at least one light fixture component.

7. The system of claim 6, wherein the at least one light fixture component is one or more of a power source, a transformer, electrical wires, electrical connectors, and combinations thereof.

8. The system of claim 1, wherein at least one of the at least three ribs is an end cap located at a terminal end of the reflector, the end cap including a structure to connect two light fixtures to each other.

9. The system of claim 1, wherein the tray base is removably attached between any two adjacent ribs of the at least three ribs.

10. The system of claim 1, further comprising a mounting bracket coupled to the tray base to attach the lighting fixture to a support structure.

11. The system of claim 1, wherein the mounting bracket is removably coupled to the tray base.

12. A system comprising:

a reflector of a suspension lighting fixture, the reflector having a reflective underside and a top side;

a tray base including a first attachment feature, the first attachment feature being at least one of a bracket opening and a fastener opening;

a tray cover attached to the tray base and defining, in cooperation with the tray base, an enclosure; and at least three ribs affixed to the top side of the reflector, each of the at least three ribs including a second attachment feature that is at least one of a bracket and a fastener opening corresponding to the fastener opening of the first attachment feature and each of the at least three ribs operate to maintain a shape of the reflector, wherein the first attachment feature and the second attachment feature operate to attach the tray base to the reflector between any two adjacent ribs of the at least three ribs.

13. The system of claim 12, wherein the enclosure defined by the tray cover attached to the tray base is to house at least one light fixture component.

14. The system of claim 13, wherein the at least one light fixture component is one or more of a power source, a transformer, electrical wires, electrical connectors, and combinations thereof.

15. The system of claim 12, wherein at least one of the at least three ribs is an end cap located at a terminal end of the reflector, the end cap including a structure to connect two light fixtures to each other.

16. The system of claim 12, wherein the tray base is removably attached between any two adjacent ribs of the at least three ribs.

17. The system of claim 12, further comprising a mounting bracket coupled to the tray base to attach the lighting fixture to a support structure.

18. The system of claim 12, wherein the mounting bracket is removeably coupled to the tray base.

19. The system of claim 12, wherein the first attachment feature and the second attachment feature matingly cooperate to attach the tray base to the reflector between any two adjacent ribs of the at least three ribs.

20. The system of claim 12, wherein at least one of the at least three ribs is not located at a terminal end of the reflector.

21. The system of claim 12, wherein each of the two adjacent ribs having the tray base attached therebetween is not located at a terminal end of the reflector.

* * * * *